US011564039B2

(12) United States Patent
Miller et al.

(10) Patent No.: US 11,564,039 B2
(45) Date of Patent: Jan. 24, 2023

(54) BALANCED ARMATURE RECEIVER AND DIAPHRAGMS THEREFOR

(71) Applicant: Knowles Electronics, LLC, Itasca, IL (US)

(72) Inventors: Thomas Miller, Arlington Heights, IL (US); Christopher Monti, Elgin, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/153,125

(22) Filed: Jan. 20, 2021

(65) Prior Publication Data

US 2022/0232323 A1 Jul. 21, 2022

(51) Int. Cl.

| | |
|---|---|
| ***H04R 7/20*** | (2006.01) |
| ***H04R 11/02*** | (2006.01) |
| ***H04R 7/14*** | (2006.01) |

(52) U.S. Cl.

CPC ..... *H04R 7/20* (2013.01); *H04R 7/14* (2013.01); *H04R 11/02* (2013.01)

(58) Field of Classification Search

CPC ... H04R 7/20; H04R 7/14; H04R 1/02; H04R 11/02

See application file for complete search history.

(56) References Cited

U.S. PATENT DOCUMENTS

| | | | | |
|---|---|---|---|---|
| 7,103,196 | B2 | 9/2006 | Warren | |
| 7,203,334 | B2 | 4/2007 | Schafer | |
| 7,302,748 | B2 | 12/2007 | Jiles | |
| 7,336,797 | B2 | 2/2008 | Thompson | |
| 7,860,264 | B2 | 12/2010 | Jiles | |
| 9,137,605 | B2 | 9/2015 | Manley | |
| 9,571,941 | B2 | 2/2017 | Heidenreich | |
| 2013/0284537 | A1 | 10/2013 | Lopresti | |
| 2015/0373456 | A1 | 12/2015 | Dayton | |
| 2018/0302721 | A1 * | 10/2018 | Di | B32B 5/02 |
| 2019/0342666 | A1 | 11/2019 | Dayton | |
| 2019/0387321 | A1 | 12/2019 | Dayton | |

FOREIGN PATENT DOCUMENTS

| | | | | |
|---|---|---|---|---|
| CN | 204291354 | | 4/2015 | |
| CN | 204350282 | | 5/2015 | |
| CN | 204350283 | | 5/2015 | |
| CN | 204350285 | | 5/2015 | |
| CN | 204350286 | | 5/2015 | |
| CN | 205830004 | | 12/2016 | |
| CN | 205830004 | U * | 12/2016 | |
| CN | 206879077 | | 1/2018 | |
| WO | WO-2018148485 | A1 * | 8/2018 | H04R 11/02 |

* cited by examiner

*Primary Examiner* — Sunita Joshi
(74) *Attorney, Agent, or Firm* — Loppnow & Chapa; Matthew C. Loppnow

(57) ABSTRACT

The present disclosure relates to a balanced armature receiver diaphragm including a paddle (202) flexibly coupled to a frame (204) and spaced apart therefrom by a gap (206). The paddle comprises a material having a specific modulus kg/m$^3$) in at least one direction and density selected to increase stiffness and reduce mass. In one implementation, at least the paddle includes a carbon fiber material. The resulting paddle has improved acoustic performance including improved frequency response and less resonance in the audio band, among other benefits.

19 Claims, 10 Drawing Sheets

BALANCED ARMATURE RECEIVER AND DIAPHRAGMS THEREFOR

TECHNICAL FIELD

This disclosure relates to sound-producing acoustic receivers and, more specifically, to balanced armature receivers having improved acoustic performance and diaphragms for such receivers.

BACKGROUND

Balanced armature receivers (also referred to herein as "receivers") capable of producing an acoustic output signal in response to an electrical input signal are known generally. Receivers typically include a coil disposed about an armature at least a portion of which is movable between permanent magnets retained by a yoke in response to an electrical input signal applied to the coil. These and other components are typically disposed within a housing. The movable portion of the armature is linked to a movable portion of a diaphragm that separates the housing into front and back volumes. Movement of the diaphragm creates an acoustic output signal at an output port of the housing. Such receivers are commonly used in hearing aids, wired and wireless earphones, some of which are known as True Wireless Stereo (TWS) devices, among others. Consumers increasingly expect hearing devices to faithfully reproduce source audio. However current receiver diaphragms are susceptible to bending and resonances that can reduce output and provide less than optimal acoustic performance.

BRIEF DESCRIPTION OF THE DRAWINGS

For a more complete understanding of the disclosure, reference should be made to the following detailed description and accompanying drawings wherein.

Figure 1:
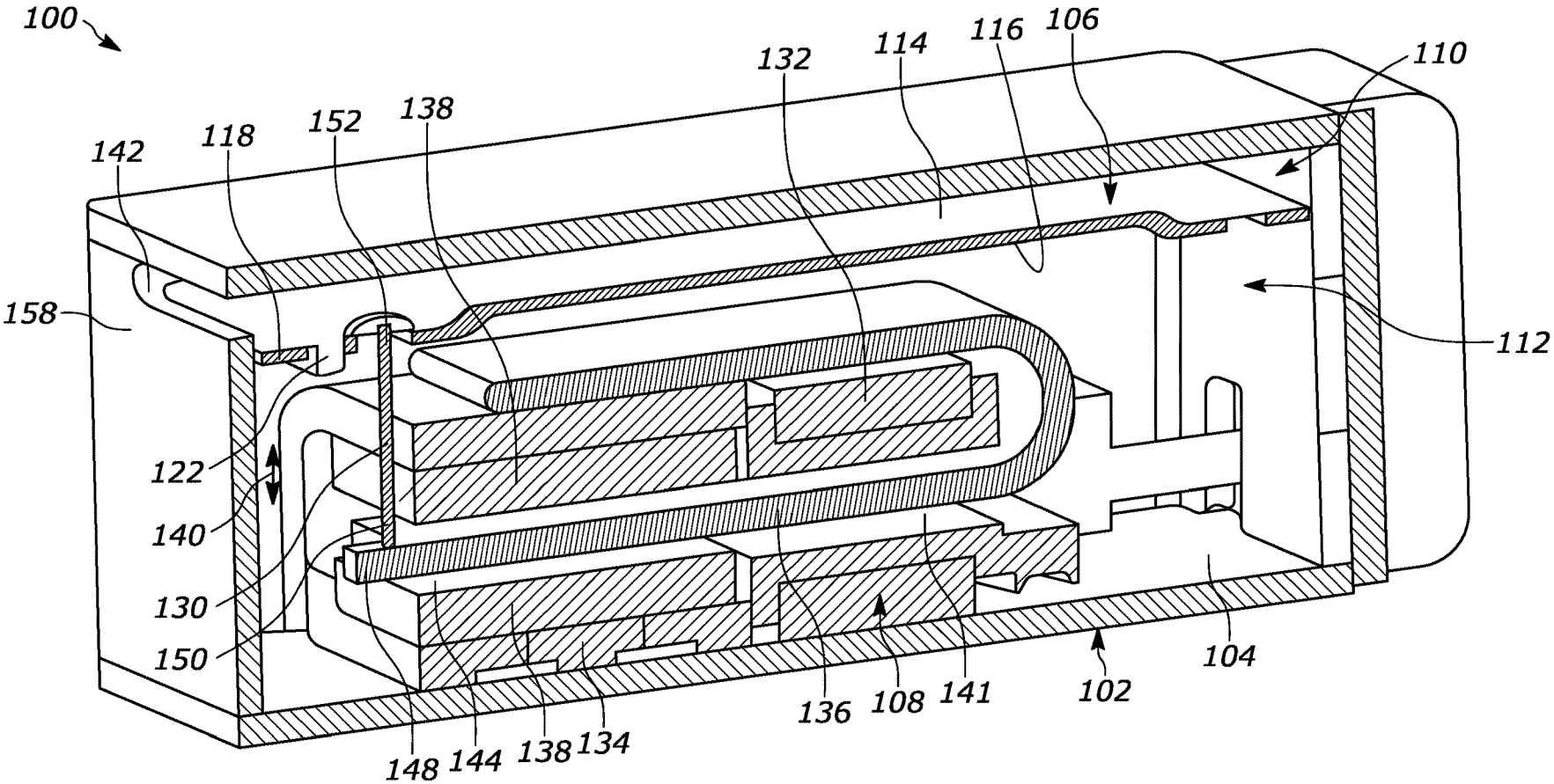
FIG. 1 is a sectional view of a balanced armature receiver having improved frequency response.

Those of ordinary skill in the art will appreciate that elements in the figures are illustrated for simplicity and clarity. It will be appreciated further that certain actions and/or steps may be described or depicted in a particular order of occurrence while those having ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The present disclosure relates to balanced armature receivers and diaphragms comprising a paddle for such receivers, wherein the paddle is structured to provide improved acoustic performance as described herein.

According to one aspect of the disclosure, the paddle comprises a material having greater stiffness, in at least one direction, than can be obtained using conventional diaphragm materials, such as aluminum or stainless steel. Increasing the stiffness of the paddle at least along its major dimension improves acoustic performance by reducing bending of the diaphragm and particularly the paddle. The increased stiffness also moves resonances to higher frequencies and permits reducing the height of the diaphragm and thus the overall size of the receiver.

The paddle can be stiffened either by changing its shape or by forming the paddle from a material having a modulus that provides the desired performance. Decreasing the mass of the paddle also increases resonant frequencies of the diaphragm. The specific modulus of a material is equal to Young's modulus/density. Young's modulus is the modulus of elasticity and is equal to the stress/strain of the material. The modulus of the material constituting the paddle can be isotropic or anisotropic. In some implementations, the paddle comprises a material having a specific modulus of at least about 30 MPa/(kg/m$^3$) in at least one dimension of the paddle. In another implementation, the paddle comprises a material having a specific modulus of at least about 28 MPa/(kg/m$^3$) in at least one dimension.

Table I below includes specific modulus data for selected isotropic and anisotropic materials from which the paddle and in some embodiments other parts of the diaphragm can be fabricated. In Table I, carbon fiber and graphene are identified as anisotropic although other known and future materials may also exhibit this property. The other materials in Table I are isotropic. Also, only Aluminum (1145-H19) and Stainless Steel (304) have a specific modulus less than 28 MPa/(kg/m$^3$).

TABLE I

| Material | Modulus (GPa) | Density (kg/m$^3$) | Specific Modulus (MPa/(kg/m$^3$) | Anisotropic |
|---|---|---|---|---|
| Aluminum (1145-H19) | 69 | 2700 | 26 | No |
| Stainless Steel (304) | 200 | 7800 | 26 | No |
| Mica | 137 | 2800 | 49 | No |
| AlBeMet 140 (40% Beryllium) | 150 | 2280 | 66 | No |
| Carbon composite fiber | 116 | 1560 | 74 | Yes |
| AlBeMet 162H (62% Beryllium) | 190 | 2100 | 90 | No |
| Beryllium | 250 | 1800 | 139 | No |
| Graphene (pure) | 2200 | 2267 | 970 | Yes |

According to another aspect of the disclosure, the paddle comprises a material having a reduced density which reduces the mass of the paddle compared to higher density materials. Reducing the mass of the paddle increases sensitivity, improves frequency response, and reduces the required stiffness of the diaphragm. In some receiver implementations, the paddle comprises a material having a density less than about 2400 kg/m$^3$. However this range may be different depending on the size and geometry of the receiver and diaphragm, among other characteristics thereof. For example, a higher density may be acceptable if weight-reducing slots are formed in the paddle to offset the increased mass associated with the higher density, provided the slotted paddle is sufficiently stiff to prevent bending and other problems associated with lack of stiffness.

In FIG. 1, a receiver 100 comprises a housing 102 having an interior 104 that contains a diaphragm 106 that is movable to create sound and a motor 108 for driving the diaphragm. The diaphragm separates the interior into a front volume 110 and a back volume 112. The diaphragm comprises, in part, a diaphragm body comprising a paddle 116 flexibly coupled to a frame 118 surrounding at least a portion of the paddle. The paddle is separated from the frame by a gap. The paddle can be coupled to the frame by one or more hinges.

Figure 11:
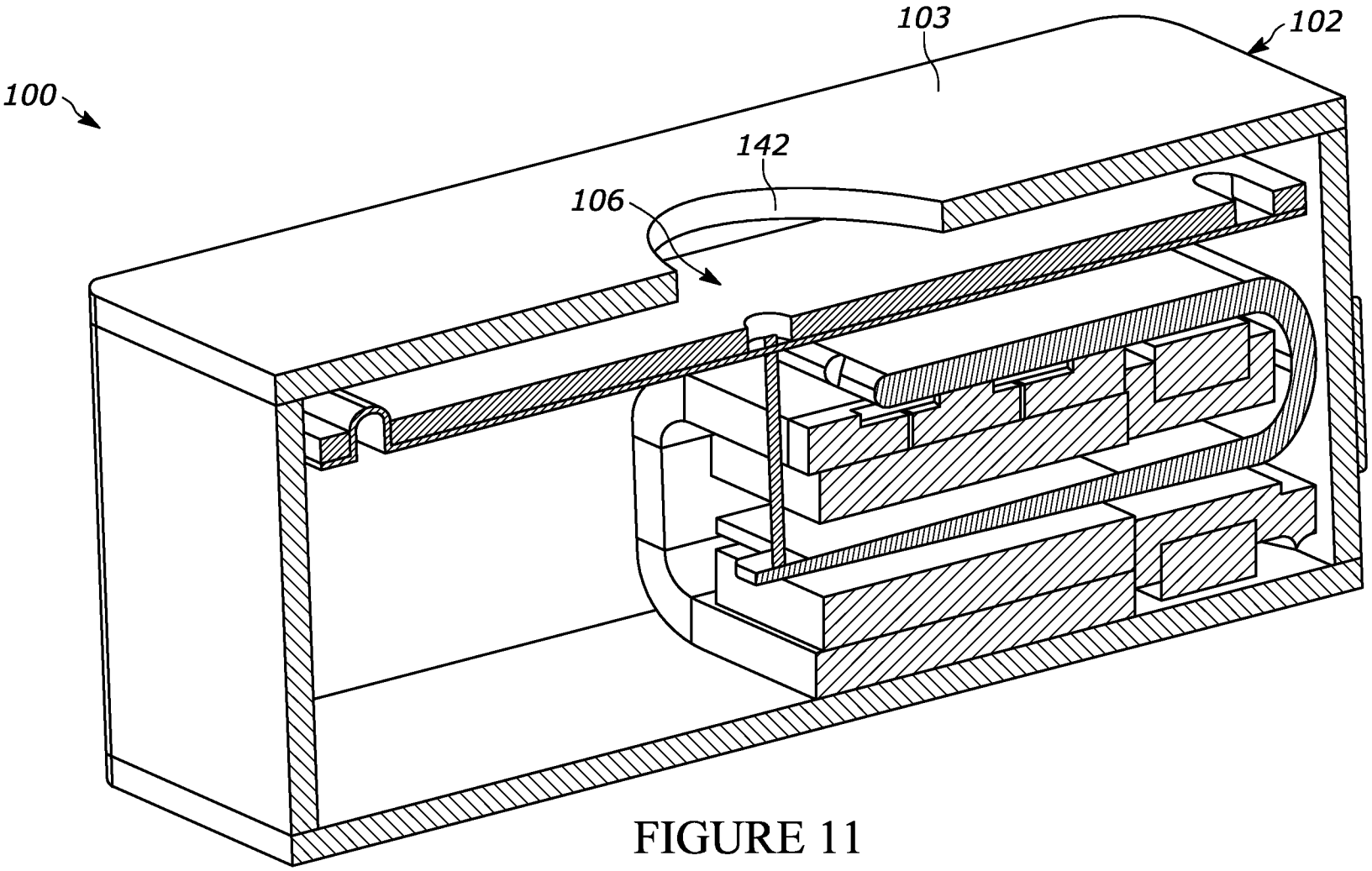
FIG. 11 is a sectional view of another balanced armature receiver having improved frequency response.

The receiver housing also comprises a sound port acoustically coupling the front volume to an exterior of the housing. In FIG. 1, the sound port 142 is disposed in an end wall portion 158 that partially defines the front volume. In FIG. 11, alternatively, the sound port 142 is disposed in a cover plate 103 of the housing 102 parallel to the diaphragm 106. The motor comprises a coil 132 magnetically coupled to an armature 136 that extends through a coil tunnel 141. A portion of the armature is movably disposed in a space 144 between magnets 138 retained by a yoke 134.

Figure 10:
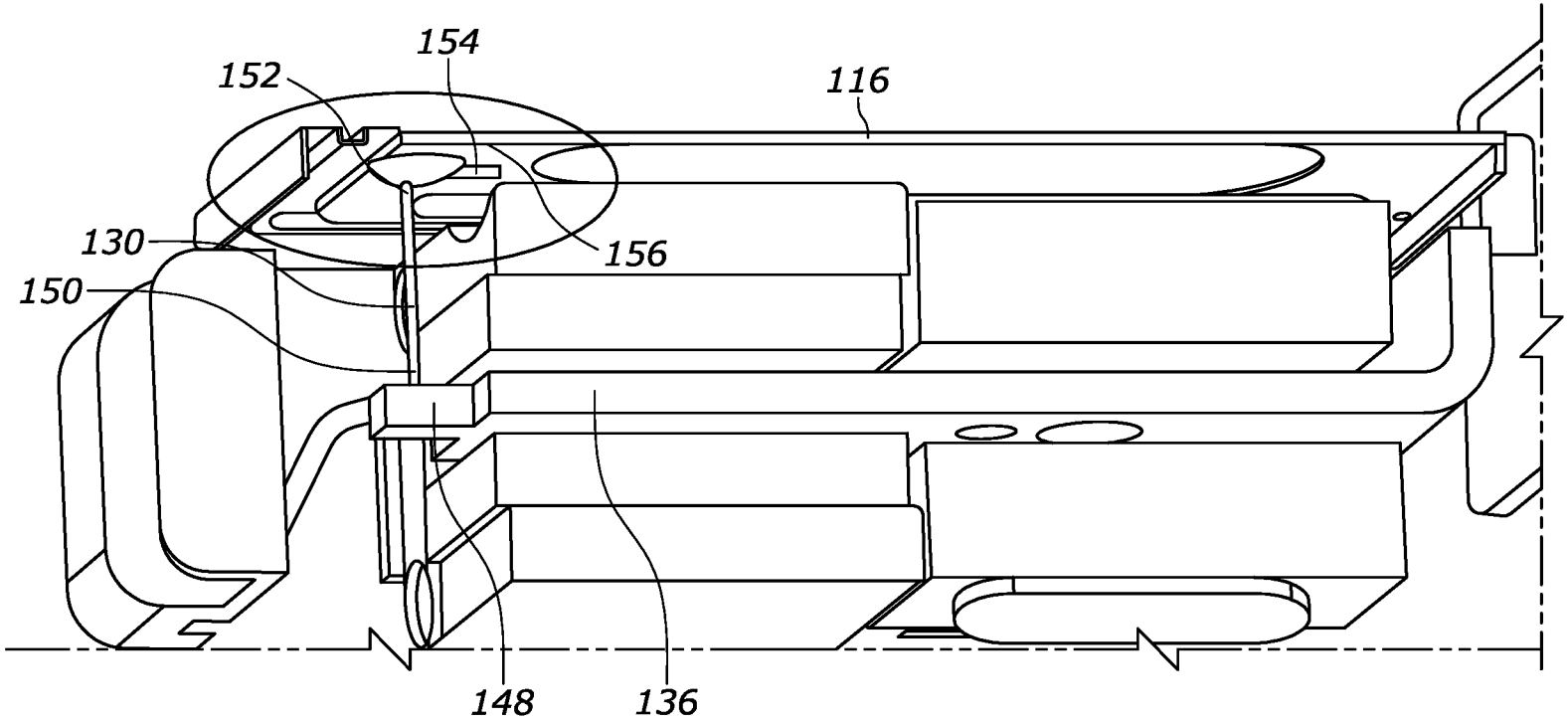
FIG. 10 is a partial view of an internal portion of a balanced armature receiver showing an alternative linkage interconnecting an armature to a paddle.

The receiver comprises a linkage connecting the movable portion of the armature to the paddle. In FIG. 1, the linkage is a drive rod 130 having a first portion 150 coupled to an end 148 of the armature by a weld, adhesive or other means. A second portion 152 of the drive rod is fastened to the paddle by an adhesive disposed in an aperture in the paddle or by some other fastening mechanism. Alternatively, the linkage can be a ribbon having a rectangular cross section coupled to the armature and to the paddle. In FIG. 10, the linkage 130 is a ribbon having a first end fastened to an end portion 148 of the armature and a second end 152 with a bent portion 154 substantially parallel, and fastened with an adhesive or other means, to an underside 156 of the paddle 116. The bent portion may be used where an aperture cannot be readily formed in the paddle or is otherwise undesirable.

Electric currents representing sounds to be produced are applied to the coil which causes the armature to move between the magnets and causes resulting movement of the paddle in directions 140, shown in FIG. 1. The movement of the paddle creates sound that is directed through the sound port.

Figure 2:
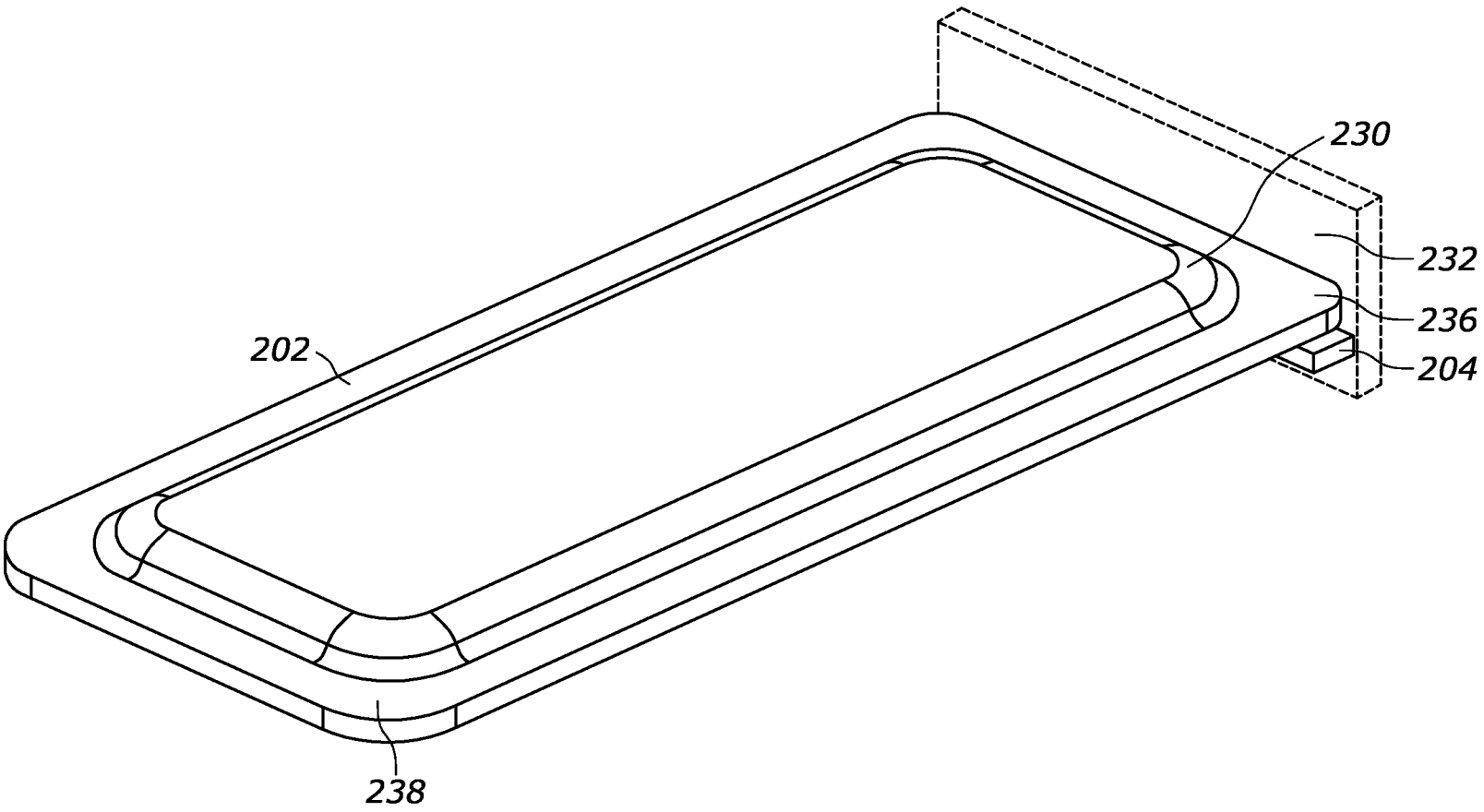
FIG. 2 is a perspective view of a ribbed paddle.
Figure 4:
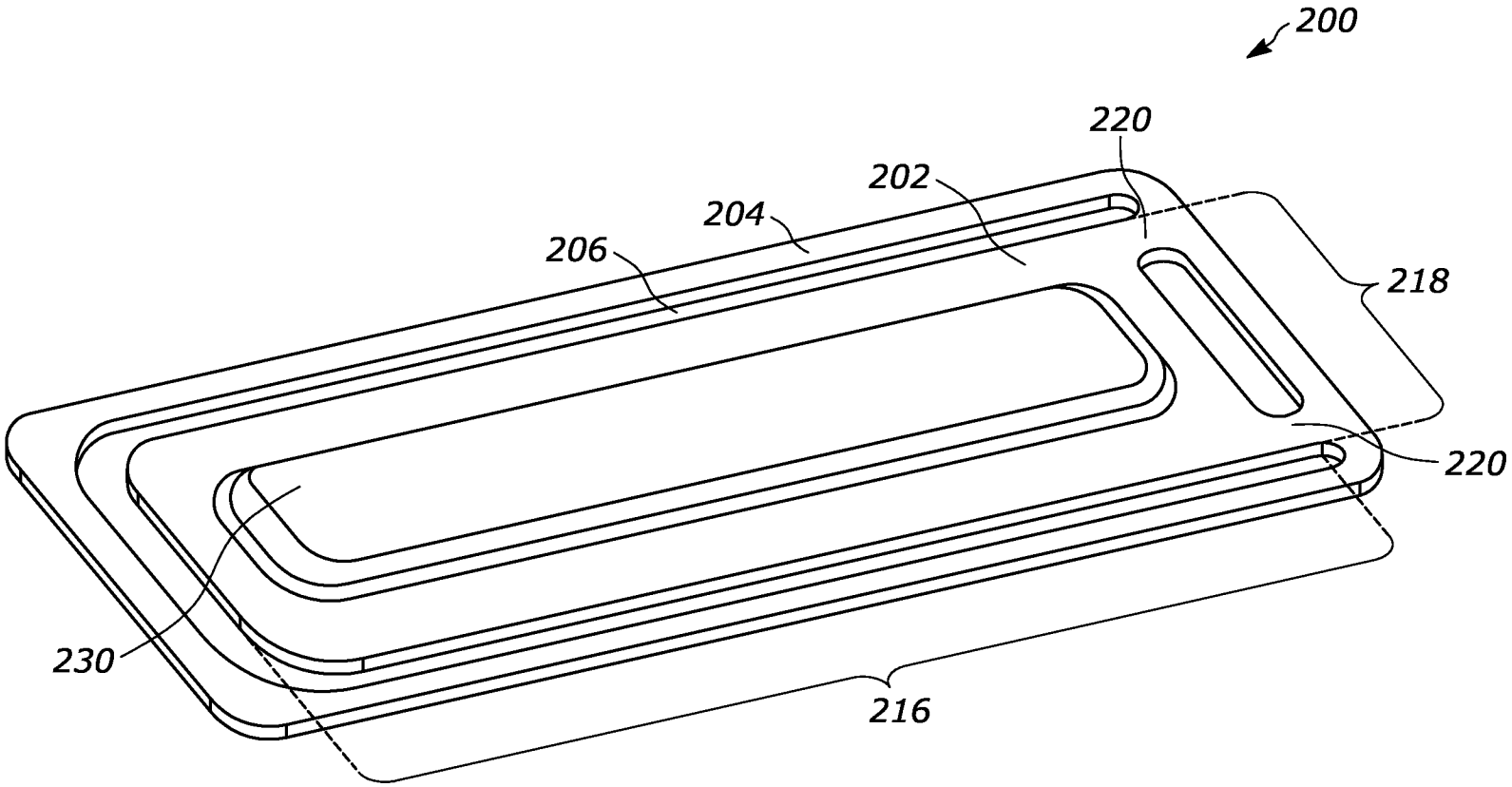
FIG. 4 is a perspective view of a unitary diaphragm body.
Figure 5:
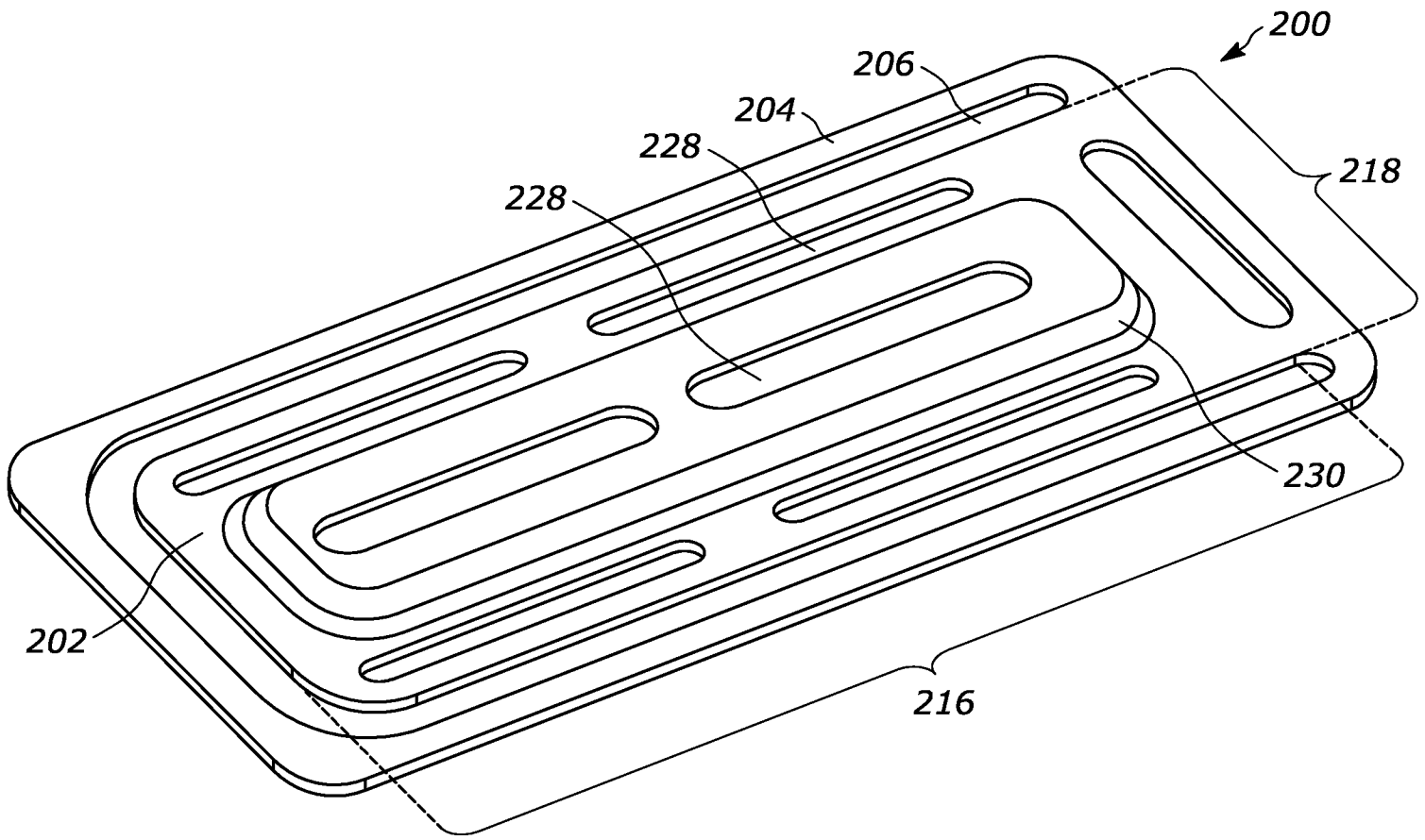
FIG. 5 is a perspective view of a unitary diaphragm body having a ribbed and slotted paddle.
Figure 6:
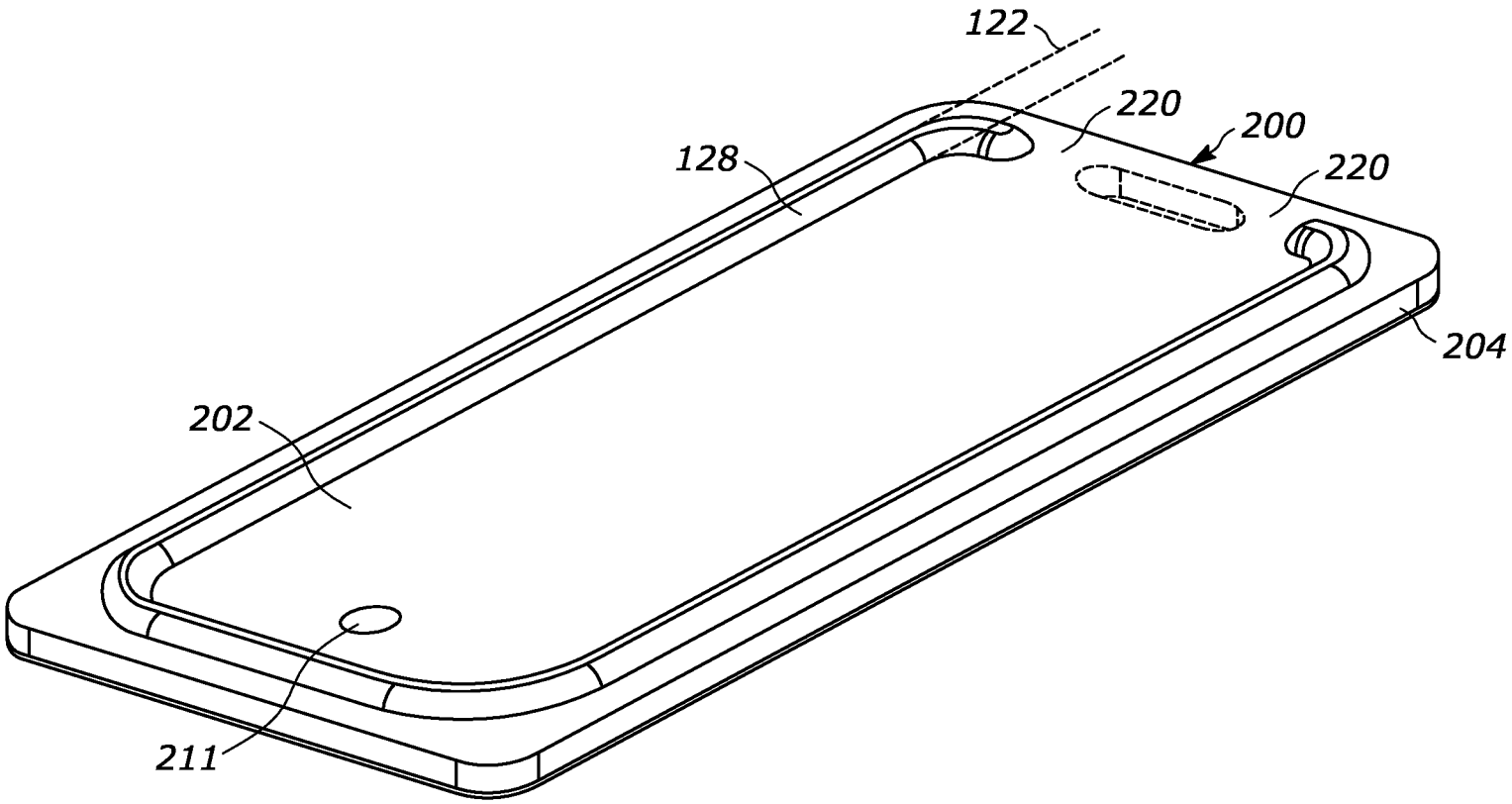
FIG. 6 is a perspective view of a diaphragm having a unitary body.
Figure 7:
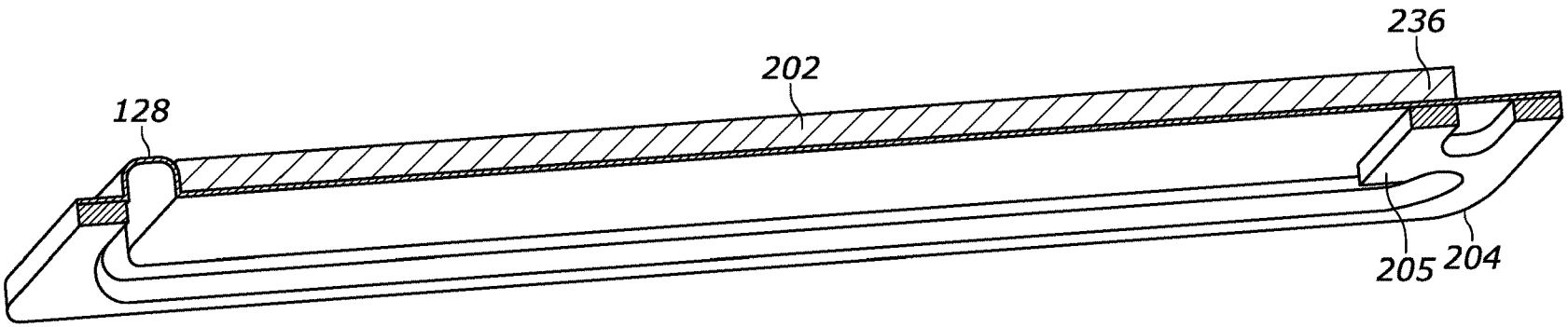
FIG. 7 is a sectional view of a diaphragm assembly.
Figure 8:
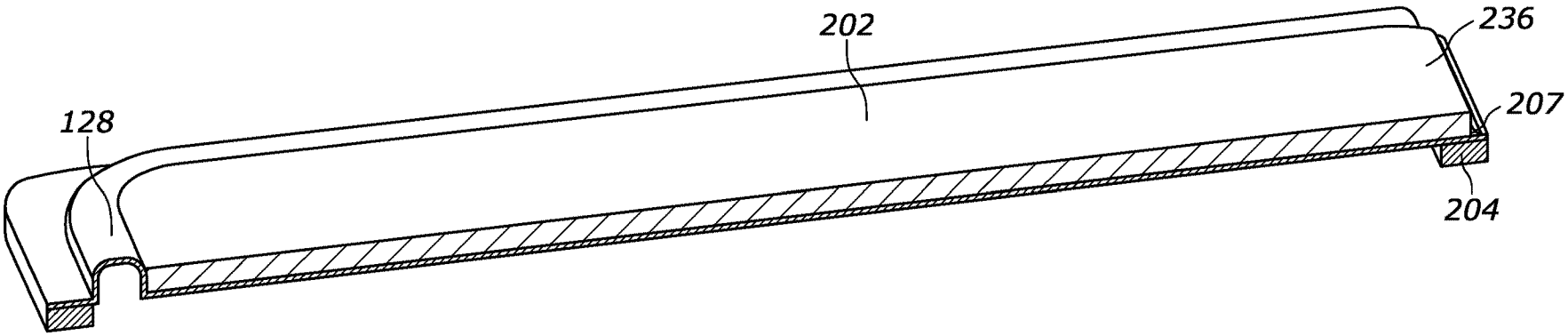
FIG. 8 is a sectional view of another diaphragm assembly.

In FIGS. 4-6, the diaphragm body 200 is an unassembled unitary member comprising a paddle 202 flexibly coupled to a frame 204 by one or more hinges 220, wherein the paddle is spaced apart from the frame by a gap 206. Alternatively, the diaphragm body can be an assembly of two or more discrete parts. In FIG. 2, the paddle 202 includes an end portion 236 flexibly fastened to a support member 204 fastened to the housing wall portion 232 to form a hinge. In FIGS. 7 and 8, the paddle 202 is flexibly fastened to a separate frame 204. The frame in FIG. 7 has an integral hinge portion 205 to which an end portion 236 of the paddle is fastened by an adhesive or other means. In FIG. 8, the end portion 236 of the paddle is fastened to the frame by adhesive 207. In this case the flexibility of the hinge is achieved through the compliance of the film, the adhesive, and, in some cases, twisting of the frame.

The diaphragm comprises a membrane (also referred to herein as a "surround") covering at least a portion of the diaphragm body and particularly the gap between the paddle and the frame. The membrane generally provides an air barrier between the front and back volumes of the housing and must be suitably flexible or resilient to permit movement of the paddle relative to the frame without undue restraint. The membrane can be a film or layer disposed on, or applied to, all or less than all, of a surface of the diaphragm body. Alternatively, the membrane can be a strip or bead of material disposed on only select portions of the frame and paddle sufficient to cover the gap. The membrane can be made from a highly elastic material (e.g., silicone) or a relatively non-elastic material having a profile and thickness that permits movement of the paddle relative to the frame. Such materials include Mylar, urethane, siloxane, and adhesive, among other known and future materials.

In FIG. 6, a membrane 128 is disposed over mostly an entire surface of the diaphragm body, except for an atmospheric pressure equalization vent 211, and covers the gap 122 between the paddle and frame. The membrane also covers the gap between the hinges 220. Alternatively, the membrane can be fastened, e.g., adhered, to only portions of the paddle and frame proximate the gap. FIGS. 7 and 8 also show a membrane 128 adhered or otherwise fastened to portions of the frame 204 and paddle 202 so that the film or membrane bridges the gap between the paddle and the frame as described herein. In other implementations, the membrane covers a gap between the paddle and the sidewall in implementations where the diaphragm body does not include a frame. The membrane is not shown in FIGS. 2-5.

Figure 3:
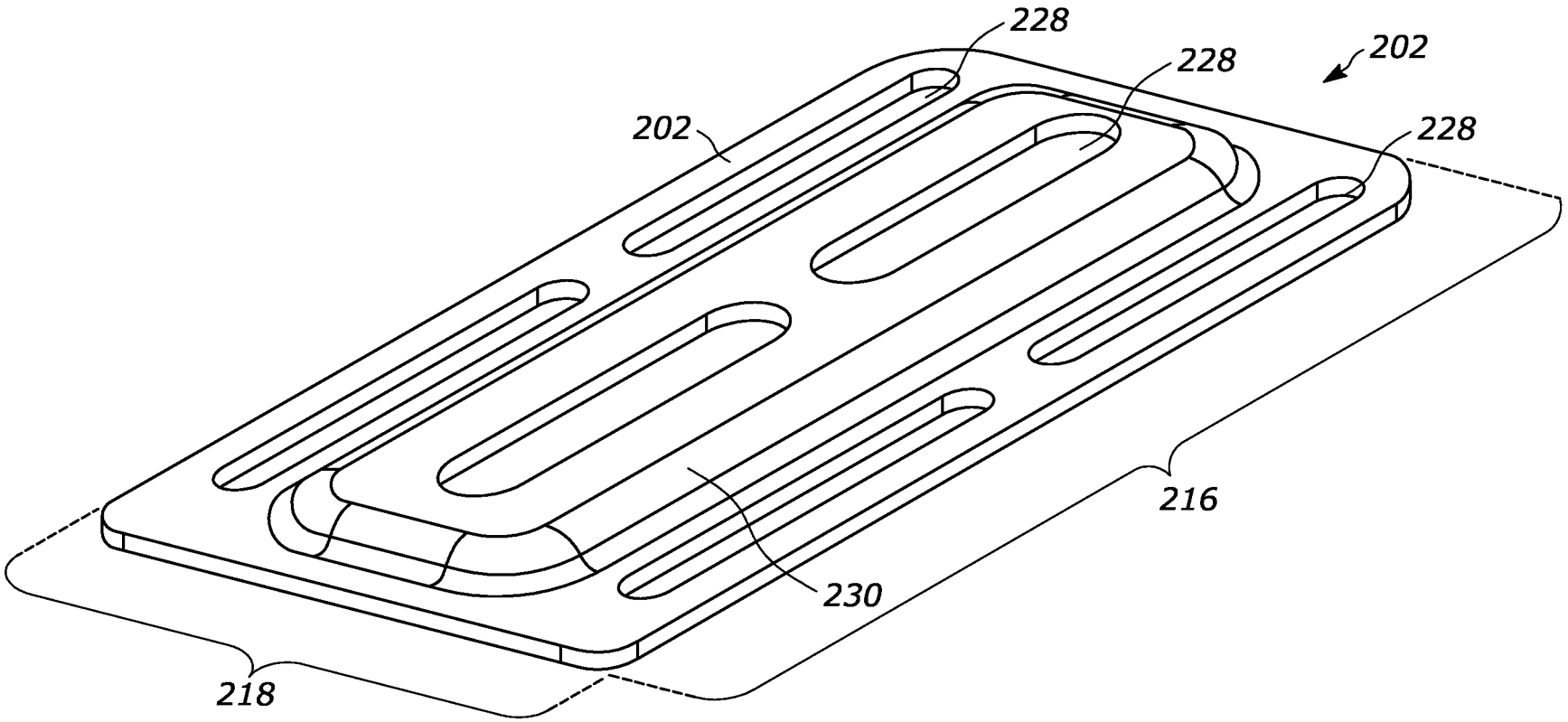
FIG. 3 is a perspective view of a ribbed and slotted paddle.

In FIGS. 3 and 5, the paddle 202 can have one or more substantial weight-reducing openings 228. Diaphragms often have a very small opening to allow pressure equalization. Such holes are typically less than 0.05 mm. An atmospheric pressure equalization or relief vent is not considered a substantial weight-reducing opening for purposed of this disclosure. Reducing the mass of the paddle improves the frequency response of the receiver. The number, shape, orientation and size of the slots depend generally on the ability of the material constituting the paddle to provide sufficient stiffness to attain the desired acoustic performance. For example, orientation of one or more elongated slots along the major dimension of the paddle can have a less adverse effect on stiffness, compared to other orientations of the slots. Also, stiffer materials may permit more or larger slots than less stiff materials. The number, shape, orientation and size of the slots also depend generally on the ability of the material that spans the slots, for example the same material used as the flexible surround film, to support acoustic pressure. Larger and wider slots will cause a highly compliant film material to flex, potentially affecting the frequency response.

In FIGS. 2-5 and FIG. 9, the paddle includes a raised rib 230 along a major dimension of the paddle 202. The rib construction enhances stiffness, which tends to shift resonances to higher frequencies. Materials having increased stiffness also permit a lower height paddle profile through lower rib height or thinner material thickness and permit use of weight-reducing openings if desired. In FIGS. 2-5, the paddle includes both ribs and weight-reducing openings.

In some implementations, the specific modulus of the paddle is greater along the major dimension of the paddle compared to the minor dimension of the paddle. FIGS. 4 and 5 show a major dimension 216 and a minor dimension 218 of the paddle. As suggested herein, the paddle can comprise a material having a specific modulus of at least about 30

MPa/(kg/m$^3$) along at least the major dimension and a density less than about 2400 kg/m$^3$. In implementations where the paddle constitutes a unitary diaphragm body, the entire diaphragm body can have the same specific modulus and density.

Figure 9:
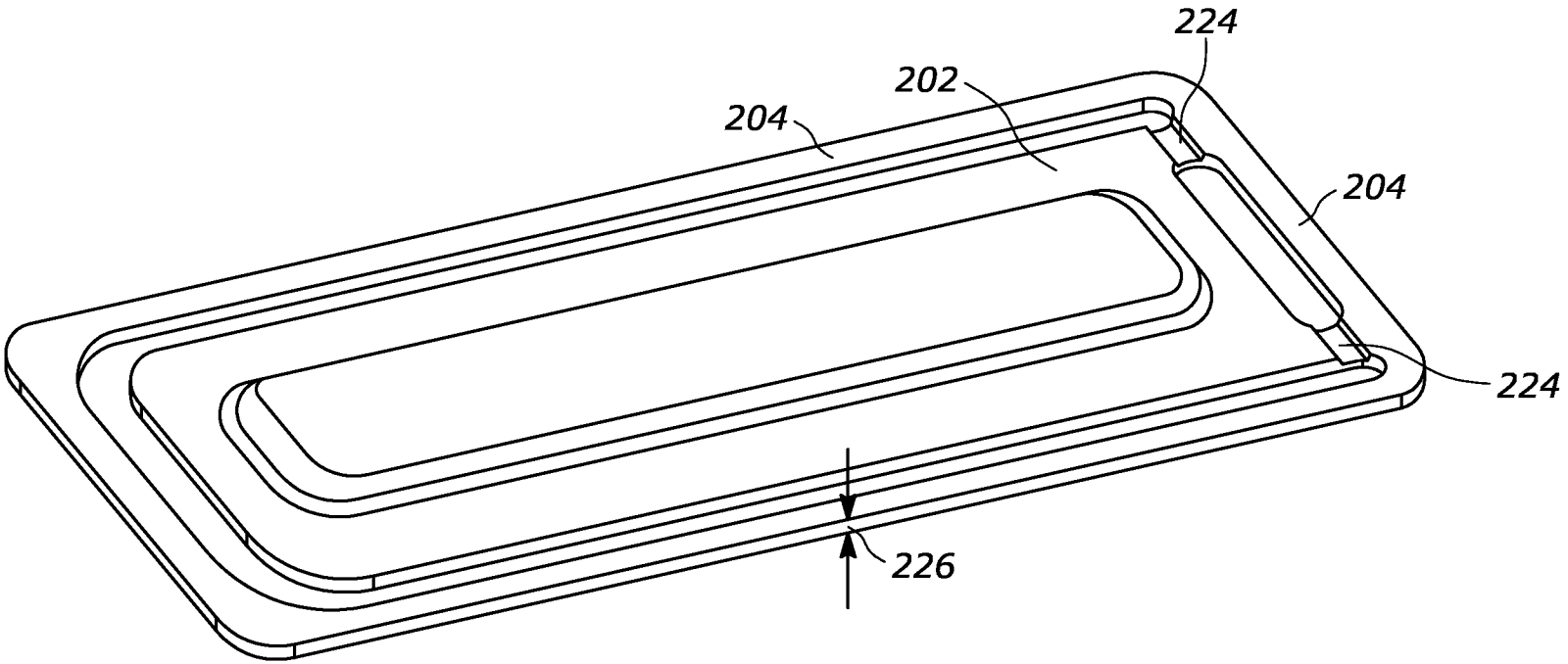
FIG. 9 is a perspective view of a unitary diaphragm body having a hinge with reduced thickness.

In FIG. 9, the hinge 224 of a unitary diaphragm has a reduced thickness compared to thickness 226 of the frame 204. The hinge having the reduced thickness has enhanced flexibility. The reduced thickness of the hinge can be formed by selectively forming the diaphragm body in a molding or other fabrication operation, or by coining or removing material from the hinge in a routing, etching, ablation or other operation after formation of the diaphragm body.

The material comprising the diaphragm body or at least the paddle thereof can comprise any one or more of carbon fiber or other composites, Mica, AlBeMet 140, AlBeMet 162 H, Beryllium, Graphene, Monolayer carbon (graphene), Bi-layer and poly-layer carbon (graphene) or Carbon nanotubes, binding media (e.g., epoxy or other adhesive) and the like. Advantageously, such candidate materials can provide a light-weight paddle material and enhanced stiffness. In some implementations, only the paddle comprises one or more of these materials and the frame comprises a more conventional material like steel or aluminum. In other implementations, the paddle, frame and hinge comprise the same material or combination of materials.

In one embodiment, at least the paddle comprises a carbon fiber composite. Such composites have a high stiffness to mass ratio, and may have a lower cost than other materials after process refinement. In implementations where the diaphragm body is an assembly of discrete components, the frame can be fabricated from the same or different material than the paddle. The material of the frame, paddle, and hinge will generally be the same for unitary diaphragm bodies. In one embodiment, the paddle is a carbon fiber and the frame is some other material, conventional or otherwise.

While the disclosure and what is presently considered to be the best mode thereof has been described in a manner that establishes possession by the inventor and that enables those of ordinary skill in the art to make and use the same, it will be understood and appreciated that there are many equivalents to the embodiments disclosed herein and that myriad modifications and variations may be made thereto without departing from the scope and spirit of the invention, which are to be limited not by the exemplary embodiments but by the appended claims and their equivalents.

What is claimed is:

1. A balanced armature receiver diaphragm comprising:
- a frame;
- a paddle flexibly coupled to the frame and spaced apart therefrom by a gap; and
- the paddle comprising a material having a specific modulus of at least 30 MPa/(kg/m3) in at least one direction,
- wherein the modulus is anisotropic and the paddle has a major dimension and minor dimension wherein the paddle has greater stiffness along the major dimension than along the minor dimension, wherein the stiffness is attributed to the material of the paddle.

2. The diaphragm of claim 1 wherein the material comprises any one or more of: carbon fiber composite, Mica, AlBeMet 140, AlBeMet 162, Beryllium, Graphene, or Carbon nanotubes.

3. The diaphragm of claim 1 wherein the paddle comprises a material having a density less than 2400 kg/m3.

4. The diaphragm of claim 1 further comprising a hinge connecting the paddle to the frame, where the frame, hinge and paddle constitute an unassembled unitary member.

5. The diaphragm of claim 4 wherein the hinge has a reduced thickness compared to the frame or the paddle.

6. The diaphragm of claim 1 further comprising one or more substantial weight-reducing openings in the paddle.

7. The diaphragm of claim 1 further comprising a raised rib along a major dimension of the paddle and a slot along the major dimension.

8. The diaphragm of claim 6 further comprising a film covering the gap and the one or more substantial weight-reducing openings.

9. The diaphragm of claim 1 in combination with:
- a housing having a sound port, the diaphragm disposed in and separating the housing into a back volume and a front volume acoustically coupled to the sound port;
- a motor disposed in the back volume and comprising a coil magnetically coupled to an armature having an end portion movably disposed between magnets retained by a yoke,
- the armature coupled to the paddle, wherein the armature moves the paddle in response to an excitation signal applied to the coil,
- wherein the combination is a balanced armature receiver.

10. The diaphragm of claim 9 further comprising a link having a first portion coupled to the armature and a second portion with a flange portion substantially parallel to an underside of the paddle, wherein the flange portion is fastened to the paddle.

11. The diaphragm of claim 9 wherein the housing includes a wall portion forming the front volume, the wall portion is substantially parallel to diaphragm, and the sound port is disposed in the wall portion.

12. A balanced armature receiver diaphragm comprising:
- a frame;
- a paddle having major and minor dimensions, the paddle flexibly coupled to the frame and spaced apart therefrom by a gap; and
- the paddle comprising a material having specific modulus that is greater in one direction than in another direction,
- wherein the paddle has greater stiffness attributed to the specific modulus along the major dimension than along the minor dimension.

13. The diaphragm of claim 12 wherein at least the paddle comprises carbon fiber.

14. The diaphragm of claim 12 wherein the paddle has a density less than 2400 kg/m3.

15. The diaphragm of claim 12 further comprising a hinge connecting the paddle to the frame, wherein the frame, hinge and paddle constitute an unassembled unitary member, and wherein the hinge has a reduced thickness compared to the frame or the paddle.

16. The diaphragm of claim 12 further comprising one or more substantial weight-reducing openings in the paddle; and an elastic or flexible film covering the gap and the one or more substantial weight reducing openings.

17. The diaphragm of claim 12 in combination with:
- a housing having a sound port, the diaphragm disposed in and separating the housing into a back volume and a front volume acoustically coupled to the sound port; a motor disposed in the back volume and comprising a coil magnetically coupled to an armature having an end portion movably disposed between magnets retained by a yoke,
- the armature coupled to the paddle, wherein the armature moves the paddle in response to an excitation signal applied to the coil.

18. The diaphragm of claim 1, wherein the anisotropic specific modulus of at least 30 MPa/(kg/m3) is along the major dimension of the paddle wherein the stiffness is attributed to the specific modulus of the material.

19. The diaphragm of claim 12, wherein the paddle comprises a balanced armature receiver diaphragm paddle.

* * * * *